US008337057B2

(12) United States Patent
Chartrand et al.

(10) Patent No.: US 8,337,057 B2
(45) Date of Patent: Dec. 25, 2012

(54) FLAMELESS CANDLE WITH THREADED INSERT AND METHOD FOR ASSEMBLING THE SAME

(75) Inventors: Mathieu Chartrand, Lery (CA); Bernard Fournier, Delson (CA)

(73) Assignee: Nii Northern International Inc., Ontario (CA)

( * ) Notice: Subject to any disclaimer, the term of this patent is extended or adjusted under 35 U.S.C. 154(b) by 67 days.

(21) Appl. No.: 13/074,304

(22) Filed: Mar. 29, 2011

(65) Prior Publication Data

US 2012/0250336 A1 Oct. 4, 2012

(51) Int. Cl.
*F21L 13/00* (2006.01)

(52) U.S. Cl. ..... 362/392; 362/161; 362/171; 362/810; 431/320

(58) Field of Classification Search ..... 362/161, 362/167, 392, 171, 810; 431/320; 441/13, 441/16; 422/123, 125
See application file for complete search history.

(56) References Cited

U.S. PATENT DOCUMENTS

| | | | | |
|---|---|---|---|---|
| 7,503,668 | B2 | 3/2009 | Porchin | |
| 8,007,144 | B2 * | 8/2011 | Lederer | 362/392 |
| 2002/0080604 | A1 | 6/2002 | Niermann | |
| 2005/0169812 | A1 * | 8/2005 | Helf et al. | 422/123 |
| 2006/0023460 | A1 | 2/2006 | Steier | |
| 2006/0177786 | A1 * | 8/2006 | Hu | 431/126 |
| 2007/0014107 | A1 * | 1/2007 | Mishan | 362/190 |
| 2007/0053181 | A1 * | 3/2007 | Urkumyan | 362/161 |
| 2007/0109782 | A1 | 5/2007 | Wolf | |

FOREIGN PATENT DOCUMENTS

| | | |
|---|---|---|
| WO | 2011/031582 | 3/2011 |

OTHER PUBLICATIONS

PCT, Notification of Transmittal of the International Search Report and the Written Opinion of the International Searching Authority, in International application PCT/CA2012/00035, dated Apr. 10, 2012.

* cited by examiner

*Primary Examiner* — Ali Alavi
(74) *Attorney, Agent, or Firm* — McAndrews, Held & Malloy, Ltd.

(57) ABSTRACT

According to embodiments of the present invention, a flameless candle is claimed, depicted, and described. The candle has a candle shell, which includes a sidewall (such as a waxen sidewall) surrounding a hollow region. There is an opening through the bottom of the candle shell leading into the hollow region. This flameless candle also has an electronics insert. The insert has a housing. At least one thread (for example, an exterior thread or male thread) is arranged on a lateral portion of the housing. This thread (or threads as used herein) can be rotated in response to a torque force on the electronics insert. The rotation causes the electronics insert to be drawn through the opening and into the hollow region, thereby substantially securing the electronics insert to the candle shell.

20 Claims, 10 Drawing Sheets

FLAMELESS CANDLE WITH THREADED INSERT AND METHOD FOR ASSEMBLING THE SAME

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Generally, the present application relates to flameless candles. Particularly, the present application relates to techniques for screwing an electronics insert into a waxen sidewall of a candle shell.

Flameless candle designs may use candle shells that include wax or a waxen material. As used herein, a waxen material is encompassing of wax, a wax substitute, or similar materials. The waxen material may allow the flameless candle to appear more like a traditional candle. While the waxen material may provide such benefits, it can be relatively expensive.

Because a flameless candle does not typically consume the candle, it may not be necessary to have a candle body that is completely solid. Instead, it may be preferable to have a hollow region within the candle body, such as a candle shell. Such a design requires less material. An electronics insert may then be inserted into the candle shell and at least partially into the hollow region.

One such candle shell is illustrated in FIGS. 1A and 1B. The candle shell 100 includes a sidewall 110 surrounding a hollow region 120. The candle shell 100 provides an opening 130 into the hollow region 120. Optionally, the candle shell 100 may include a well 160 having a bottom 140 and an ornamental wick 150.

Techniques for inserting the electronics insert into the candle shell may involve one or more intermediate steps. For example, it may be useful to secure the electronics insert to the candle shell. One technique for securing the electronics insert is to place the insert into the candle shell. Subsequently, hot wax or another sealant can be added between the electronics insert and the candle shell.

This process, however, can be relatively expensive and time consuming during the manufacturing process. Of course, the sealant has an associated material. Additionally, the steps of adding the sealant and waiting for drying take time. Furthermore, it may be useful to regulate the insertion depth of the electronics insert into the candle shell before applying the sealant. Moreover, the electronics insert may be damaged by the sealant (for example, hot wax) and, therefore, it may be useful to perform an additional step of protecting the insert before the sealant is applied. These techniques may also require a relatively complex production flow and expensive machine costs.

BRIEF SUMMARY OF THE INVENTION

According to embodiments of the present invention, a flameless candle is claimed, depicted, and described. The candle has a candle shell, which includes a sidewall (such as a waxen sidewall) surrounding a hollow region. There is an opening through the bottom of the candle shell leading into the hollow region.

This flameless candle also has an electronics insert. The insert has a housing. At least one thread (for example, an exterior thread or male thread) is arranged on a lateral portion of the housing. This thread (or threads as used herein) can be rotated in response to a torque force on the electronics insert. The rotation causes the electronics insert to be drawn through the opening and into the hollow region, thereby substantially securing the electronics insert to the candle shell.

In an embodiment, the thread of this candle is a self-tapping thread which cuts into the waxen sidewall. Another option would be to have interior threads (for example, female threads) on the interior of the waxen sidewall. In an embodiment, the electronics insert can be substantially drawn into the hollow region after being rotated approximately one quarter of a turn.

This flameless candle could have a first step, which may or may not be tapered. In another embodiment, the threadform of the threads on the lateral wall of the housing of the electronics insert has a trapezoidal threadform or cross-section.

According to embodiments of the present invention, a method for assembling a flameless candle is claimed, depicted, and described. According to the method an opening in a bottom of a waxen sidewall of a candle shell is aligned with a lateral portion of a housing of an electronics insert. There are exterior threads located on the lateral portion. The threads may be self-tapping. The end portions of the threads are engaged with the waxen sidewall. The electronics insert is then rotated. This causes the threads to rotate as well. The threads then cut into the waxen sidewall. As the threads rotatably cut into the waxen sidewall, the electronics insert is drawn into a hollow region in the candle shell.

The rotation of the electronics insert and the threads may be facilitated through the use of a tool. The tool may be inserted into the battery compartment of the electronics insert. The electronics insert may be rotated while the waxen sidewall is still, or vice versa.

A first step may be formed in the interior of the waxen sidewall. This first step may be tapered. In such embodiment (s), the threads may engage a portion of the first step. As the threads are rotated, they cut into the first step of the waxen sidewall, thereby causing the electronics insert to be drawn into the hollow region.

Figure 1A:
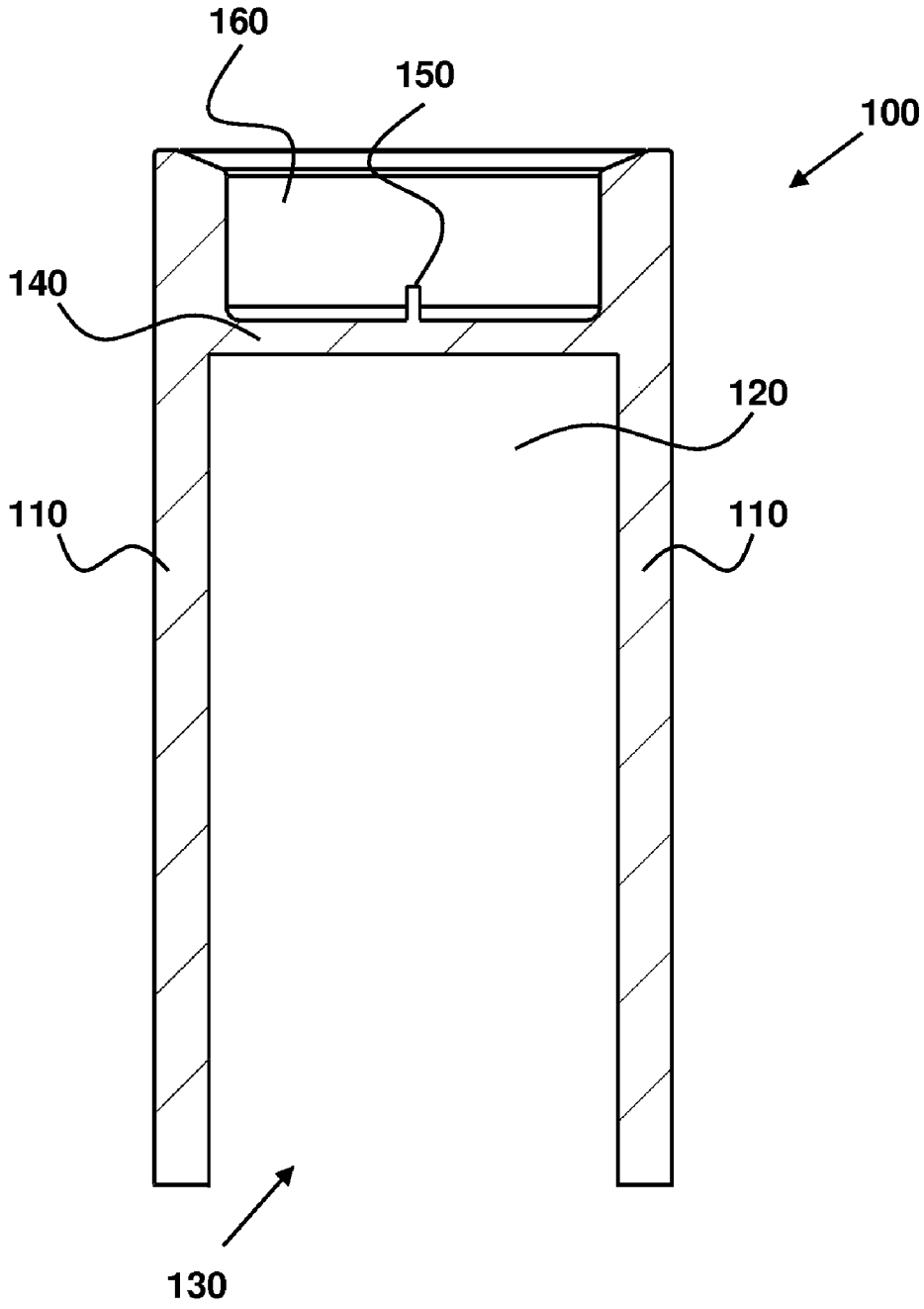
FIG. 1A shows a vertical cross-sectional view of a candle shell for use in the present invention.

The foregoing summary, as well as the following detailed description of certain embodiments of the present invention, will be better understood when read in conjunction with the appended drawings. For the purposes of illustration, certain embodiments are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE INVENTION

Figure 2A:
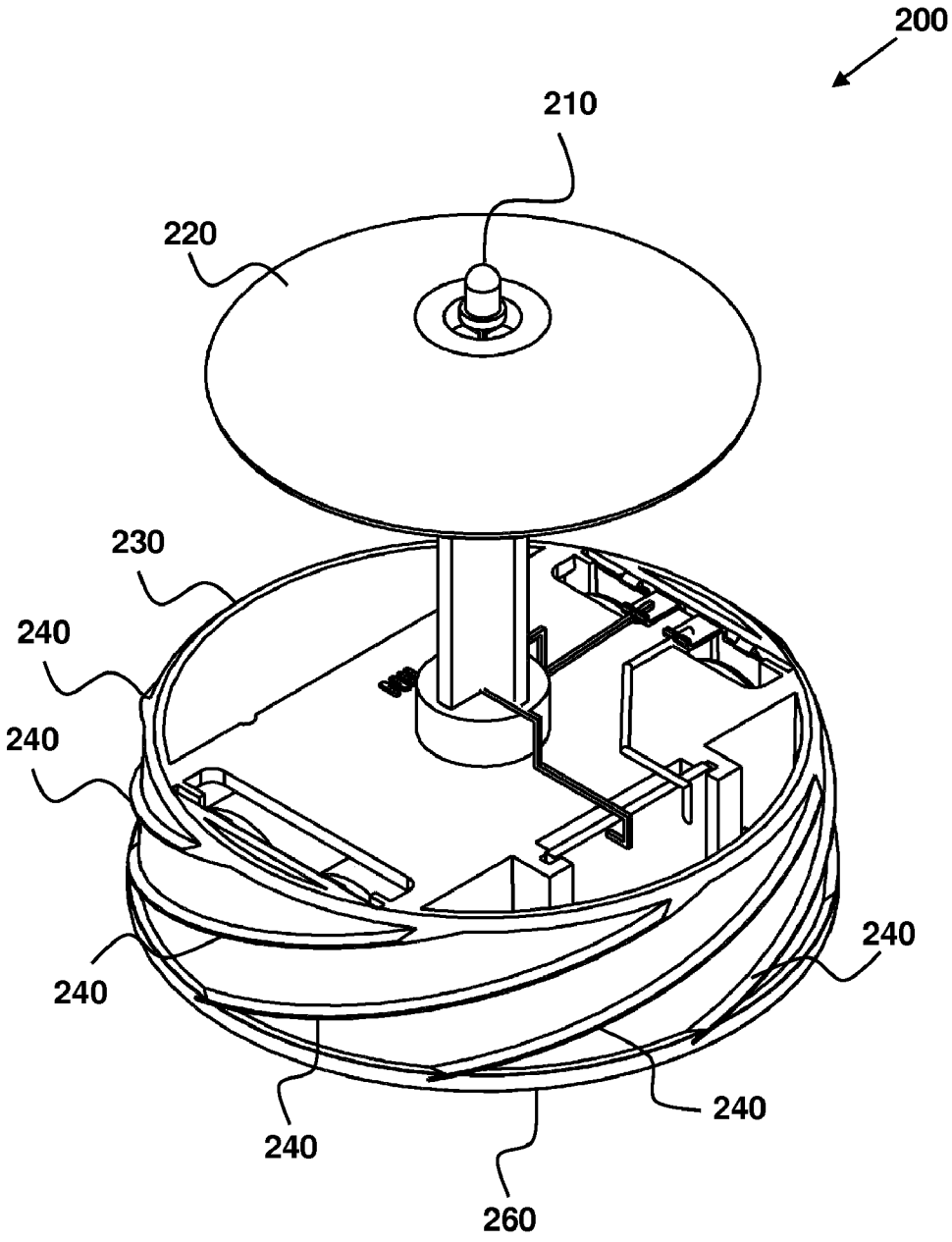
FIG. 2A shows an exterior view of an electronics insert, according to an embodiment of the present invention.
Figure 2B:
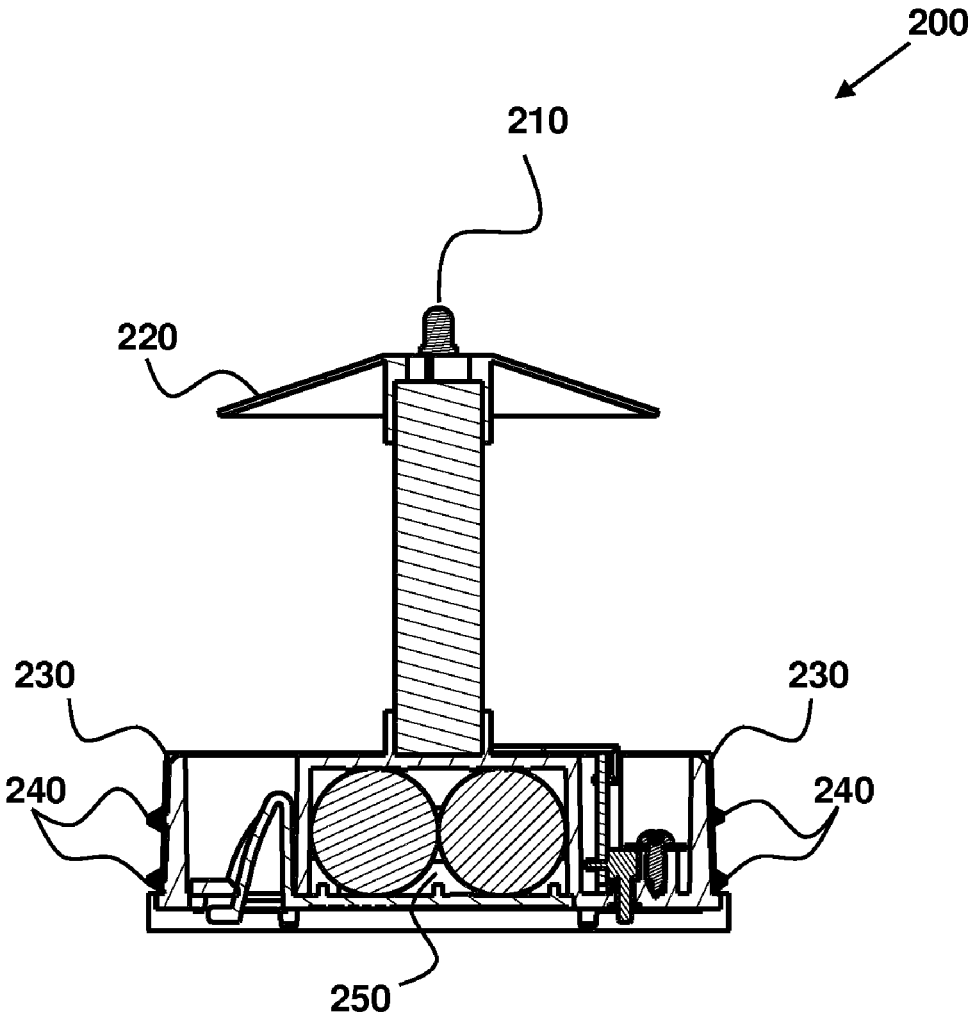
FIG. 2B shows a vertical cross-sectional view of an electronics insert, according to an embodiment of the present invention.

FIGS. 2A and 2B show views of an electronics insert 200, according to an embodiment of the present invention. The electronics insert may include a light-emitting diode ("LED") 210, a light diffusing member 220, a lateral portion 230 of a housing, one or more threads 240, and a battery compartment 250.

The LED 210 may produce a flickering light when turned on. The light diffusing member 220 may diffuse the light emitted by the LED 210 to promote the illusion of a traditional candle. The battery compartment 250 may be opened from the bottom of the electronics insert 200, for example, with a spring-latched door. The battery compartment 250 may hold the batteries that provide power to the LED 210. The electronics insert 200 may also include a base 260. As shown, the exterior of the lateral portion 230 is tapered (that is, it is shown having an angle that is not perpendicular to the base 260), although other orientations are possible—for example, non-tapered.

One or more threads 240 may be located on the lateral portion 230 of the housing. The threads 240 may be exterior threads. There may be a plurality of threads 240. In an embodiment, there are eight threads 240. One or more threads 240 may have a trapezoidal threadform—that is, cross-sectional profile of the thread 240. Other shapes are possible, such as triangular, square, etc. The threads 240 may have end portions. The end portions may have a different threadform or cross-sectional profile. For example, the end portions may be tapered. As used herein, the term "threads" means one or more threads.

Figure 1B:
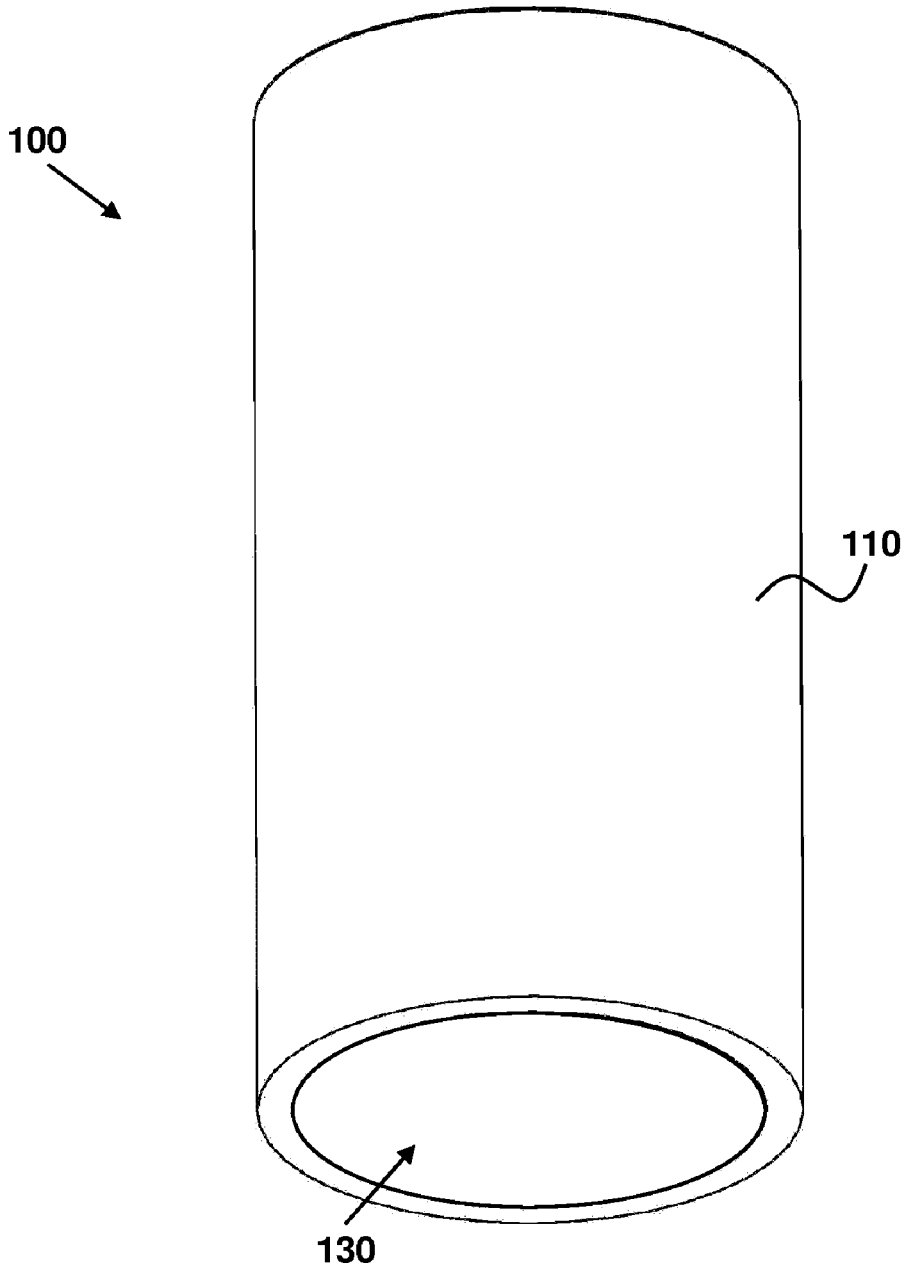
FIG. 1B shows an exterior view of a candle shell for use in the present invention.
Figure 3A:
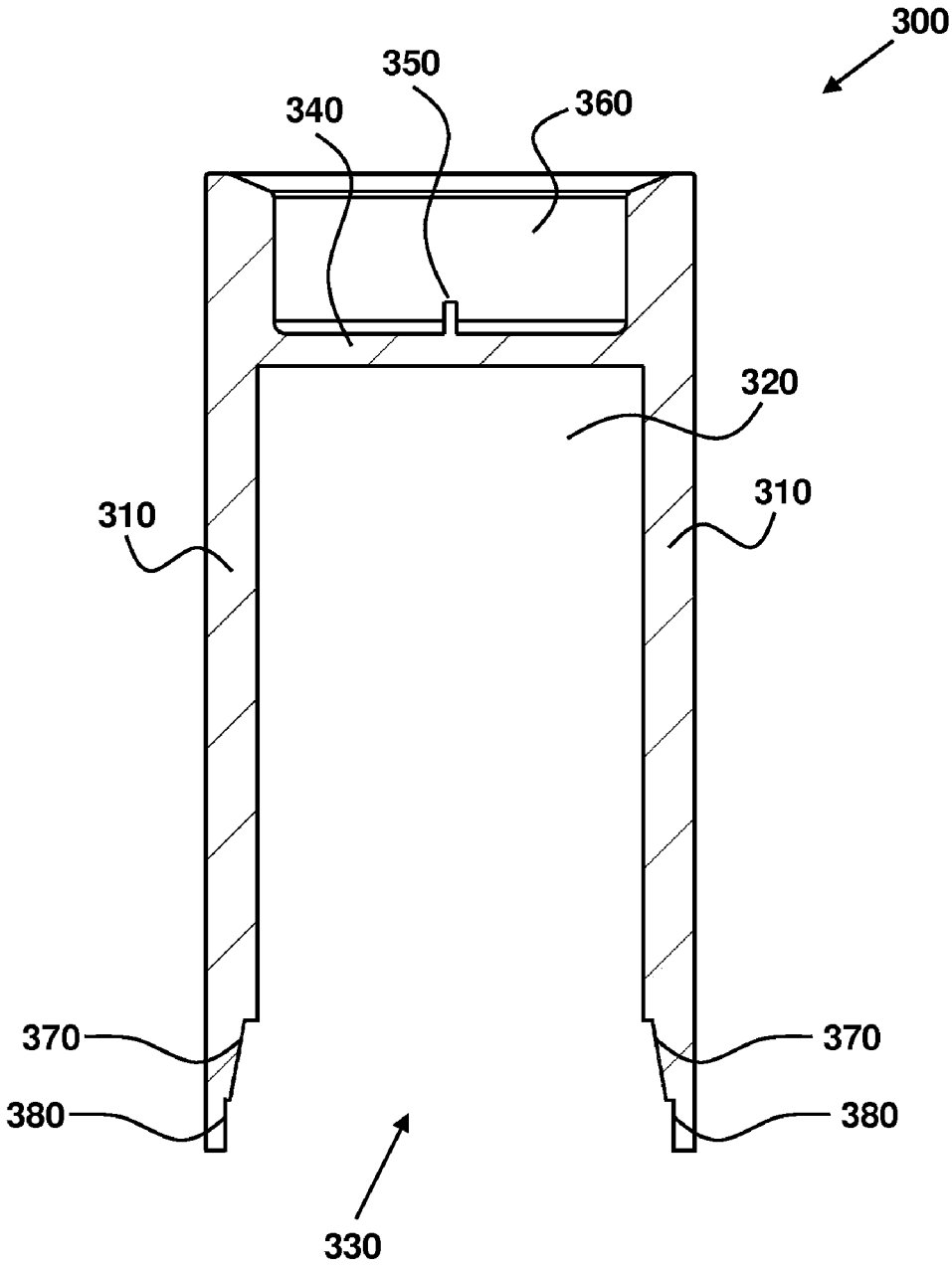
FIG. 3A shows a vertical cross-sectional view of a candle shell, according to an embodiment of the present invention.
Figure 3B:
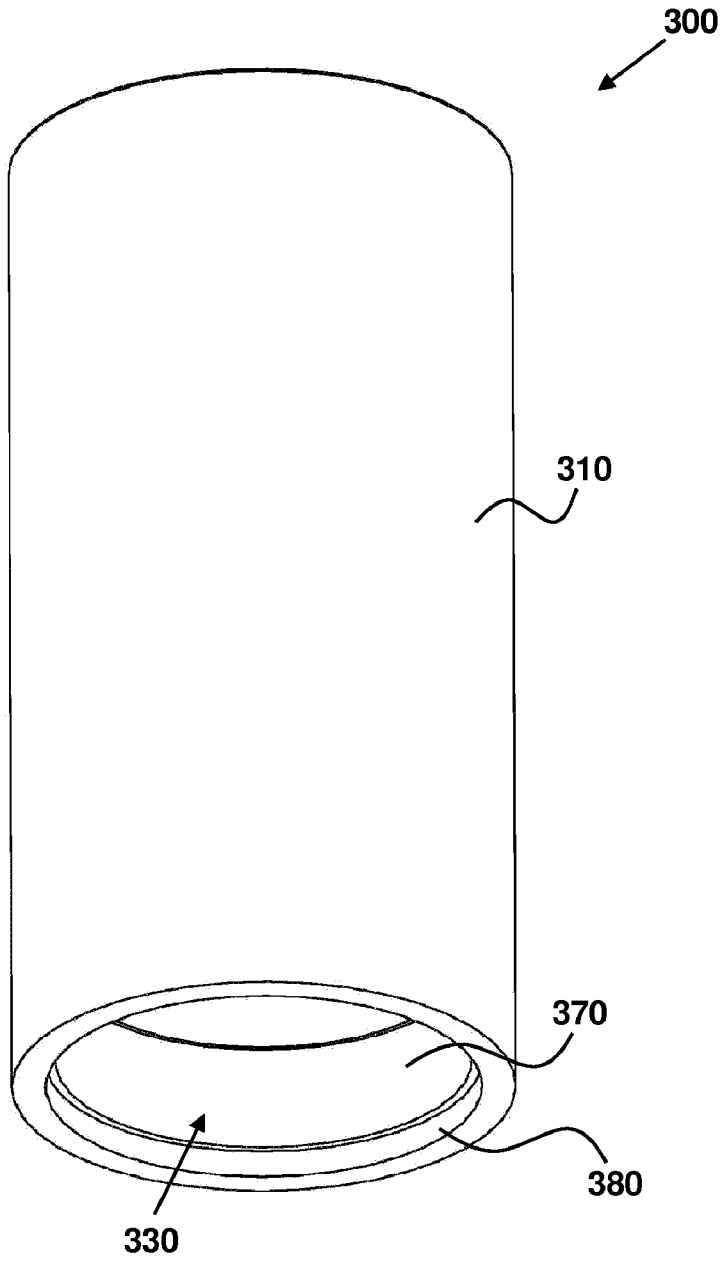
FIG. 3B shows an exterior view of a candle shell, according to an embodiment of the present invention.

FIGS. 3A and 3B show views of a candle shell 300, according to an embodiment of the present invention. The candle shell 300 may be similar to the candle shell 100 (shown in FIGS. 1A and 1B) in certain respects. The candle shell 300 may include a waxen sidewall 310 surrounding a hollow region 320. The candle shell 300 provides an opening 330 into the hollow region 320. The candle shell 300 may include a well 360 having a bottom 340 and an ornamental wick 350.

The candle shell 300 may also include a first step 370 and a second step 380. As shown, the first step 370 may be tapered, though it may be non-tapered or have some other orientation. At the first and second steps 370, 380, the waxen sidewall 310 becomes progressively thinner. Other options are also available, such as a waxen sidewall 310 that becomes progressively thicker at the first and second steps 370, 380, or the waxen sidewall 310 could have some other thickness variation. The first step 370 may generally compliment the profile of the exterior of the lateral portion 230 of the electronics insert. The second step 380 may generally compliment the profile of the base 260.

The first step 370 and/or second step 380 may be formed in the waxen sidewall 310 in different ways. For example, the step(s) may be formed after the formation of the waxen sidewall 310. In such an example, the candle shell may be similar to candle shell 300. Portions of the waxen sidewall may then be removed to form the step(s). Other techniques are possible, such as forming the step(s) at the same time the rest of the waxen sidewall 310 is formed (for example, as part of a molding process).

Figure 4:
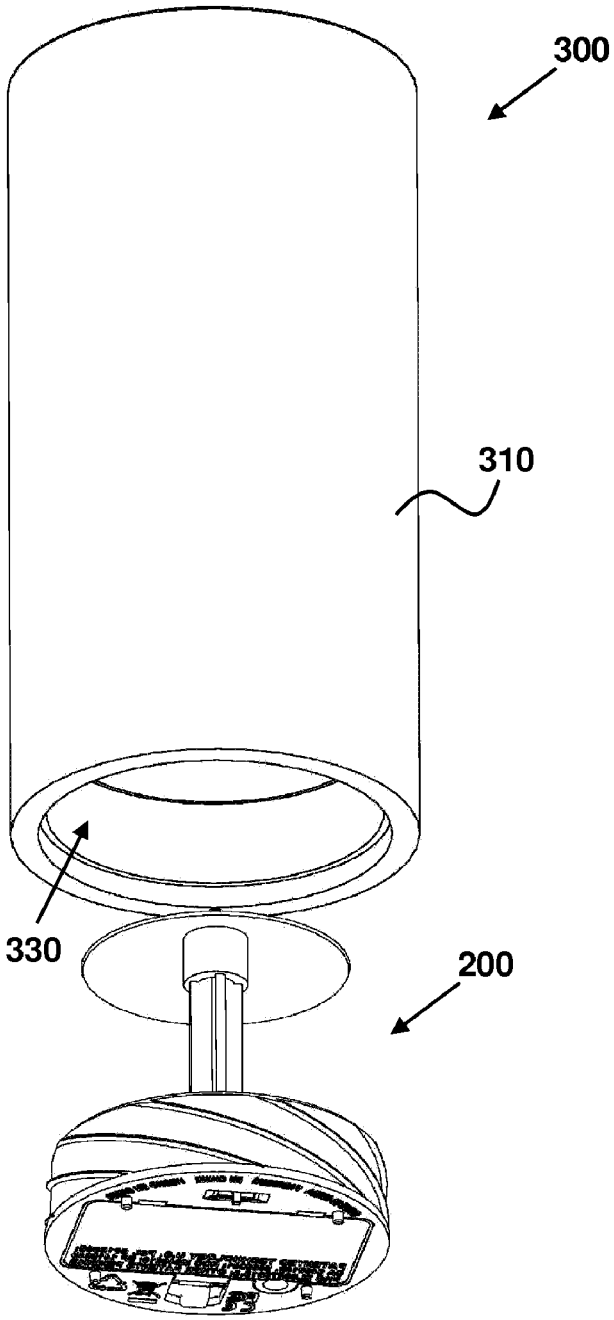
FIG. 4 shows components of a flameless candle prior to final assembly, according to an embodiment of the present invention.

FIG. 4 shows components of a flameless candle prior to final assembly, according to an embodiment of the present invention. The components include the candle shell 300 and the electronics insert 200. If the candle shell 300 has one or more steps (for example, first step 370 or second step 380), the radius of the opening 330 may become progressively narrower.

The profile of the opening 330 (see, for example, FIG. 3) may generally correspond to the lateral profile of the electronics insert 200. For example, the radius of the opening 330 at the second step 380 may generally correspond to the radius of the base 260 of the electronics insert 200 within a certain tolerance. Additionally, the radius of the opening 330 at the first step 370 may generally correspond to the radius of the lateral portion 230 of the electronics insert 200 within a certain tolerance. If the exterior of the lateral portion 230 is tapered, the first step 370 may also have a corresponding taper.

Figure 5:
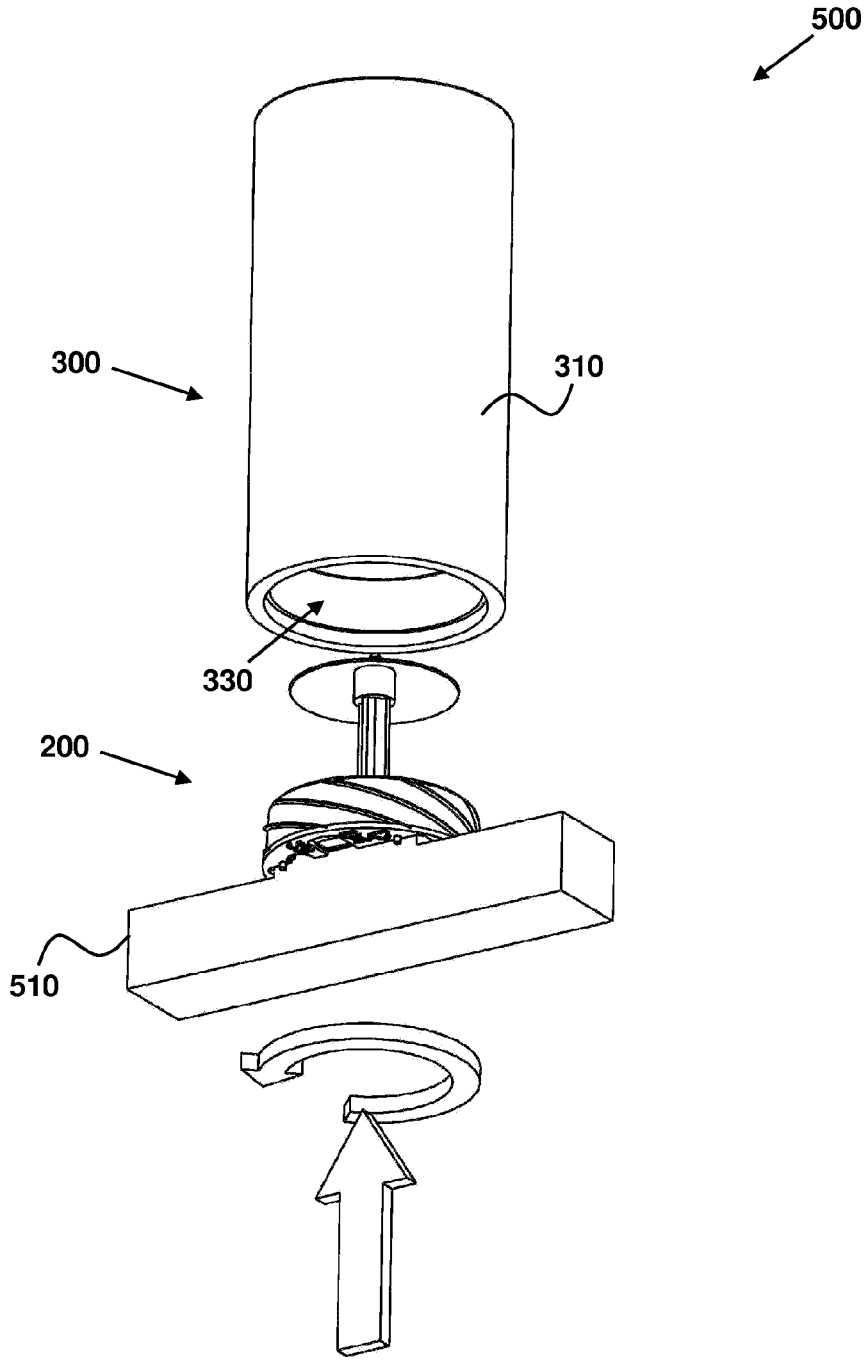
FIG. 5 illustrates assembly techniques for manufacturing a flameless candle, according to an embodiment of the present invention.

Referring to FIGS. 3A, 4, and 5, the threads 240 may be configured to engage with the waxen sidewall 310. The threads 240 may also be configured to draw the electronics insert 200 through the opening 330 and into the hollow region 320 of the candle shell 300 in response to a torque force and secure the electronics insert 200 to the candle shell 300. The threads 240 may be self-tapping. For example, the threads 240 may rotatably cut into the waxen sidewall 310. If the threads 240 are self-tapping, it may be possible to secure the electronics insert 200 to the candle shell 300 even when there are no interior threads on the inside of the waxen sidewall 310.

In order to substantially secure the electronics insert 200 to the candle shell 300, a certain amount of rotation may be required. The number of threads 240 and their corresponding pitch may indicate how much rotation is required. In an embodiment, there is a plurality of threads 240. In one particular example, there are eight threads 240. In this example, the threads 240 have a pitch such that the electronics insert 200 is substantially inserted into the candle shell 300 after one-quarter of a turn. Of course, the process of substantial insertion may be achieved after more or less than one-quarter of a turn.

FIG. 5 illustrates assembly techniques for manufacturing a flameless candle, according to an embodiment of the present invention. The opening 330 in the bottom of the waxen sidewall 310 may be aligned with the electronics insert 240. For example, the opening 330 may be aligned with the lateral portion 230 of the housing of the electronics insert 200 (see, for example, FIGS. 2A and 2B). Subsequently or simultaneously, end portions of the threads 240 may engage with the waxen sidewall 310.

After engagement, the electronics insert 200 may be rotated with respect to the candle shell 300 so that the threads 240 rotatably cut into the waxen sidewall 310. The electronics insert 200 may be rotated clockwise or counterclockwise with respect to the candle shell 300. As the threads 240 are cutting into the waxen sidewall 310, the electronics insert 200 may be responsively drawn into the hollow region 330 of the candle shell 300. The rotation may be facilitated by one or more tools, such as tool 510. The exemplary tool 510 may be inserted into the battery compartment 250 of the electronics insert 200. The electronics insert 200 may rotate while the position of the candle shell 300 is substantially maintained. Optionally, the position of the electronics insert 200 may be substantially maintained while the candle shell 300 is rotated. As another example, both the electronics insert 200 and the candle shell 300 may be complimentarily rotated. In addition to the torque force used for rotation, an inward force may also be applied to the electronics insert 200 and/or the candle shell 300.

Figure 6:
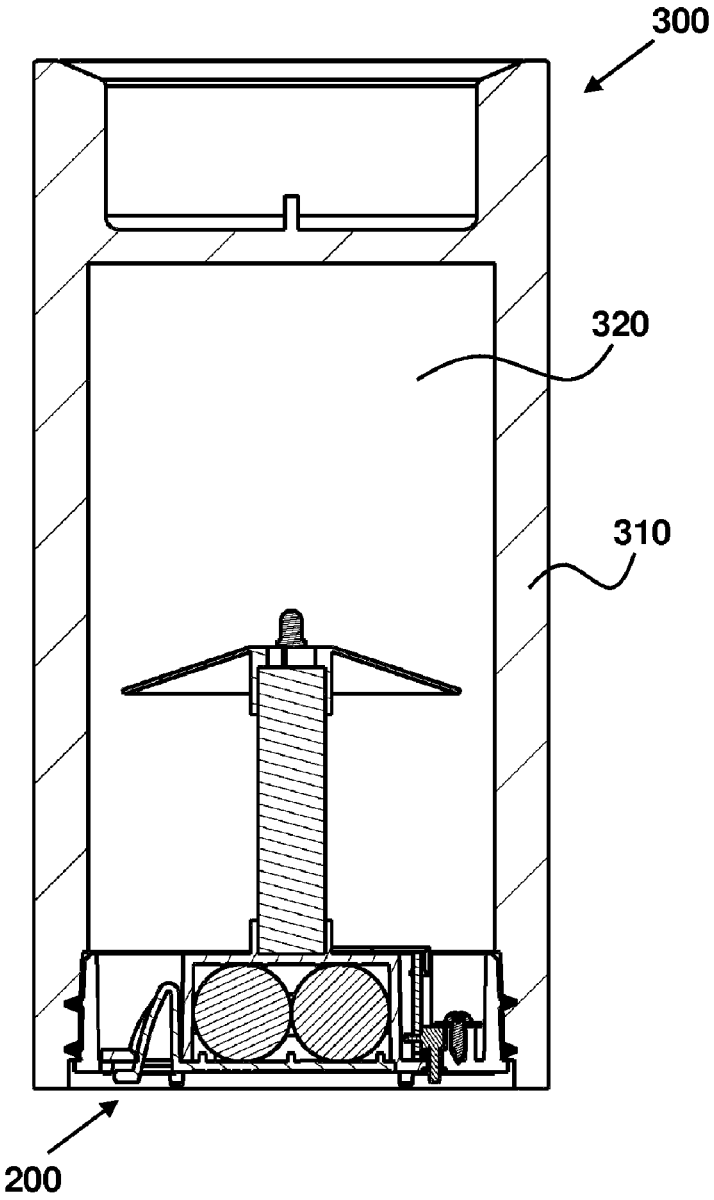
FIG. 6 shows a flameless candle, according to an embodiment of the present invention.

If the candle shell has a first step 370, then the threads 240 may engage in the first step 370 of the waxen sidewall 310. As the electronics insert 200 is drawn into the candle shell 300, the insert 200 may land in a position that is complementary to the first step 370. For example, as shown in FIG. 6, a tapered lateral portion 230 of the housing of the housing of the electronics insert 200 rests in a position that is complimentary to the first step 370. The same configuration may also be achieved when the first step 370 is not tapered. Similar to the complimentary positioning of the lateral wall 230 with the first step 370, the base 260 may have a complimentary shape to the second step 380 of the waxen sidewall 310.

FIG. 6, in context with FIGS. 2B and 3A, shows a flameless candle, according to an embodiment of the present invention. As shown in FIG. 6, the threads 240 of the electronics insert 200 may be wider than the radius of the waxen sidewall 310 at certain locations. For example, if the profile of the first step 370 corresponds to the profile of the lateral portion 230, then the outer radius of the threads 240 may extend into the waxen sidewall 310 at the first step 370. As shown, the threads 240 are exterior self-tapping and there are no corresponding interior threads on the waxen sidewall 310 of the candle shell 300. The threads 240 (or at least a portion of the threads) become embedded in the waxen sidewall 310, thereby substantially securing the electronics insert 200 to the candle shell 300. Also as shown, the base 260 of the electronics insert 200 rests in a complimentary position to the second step 380.

Figure 7:
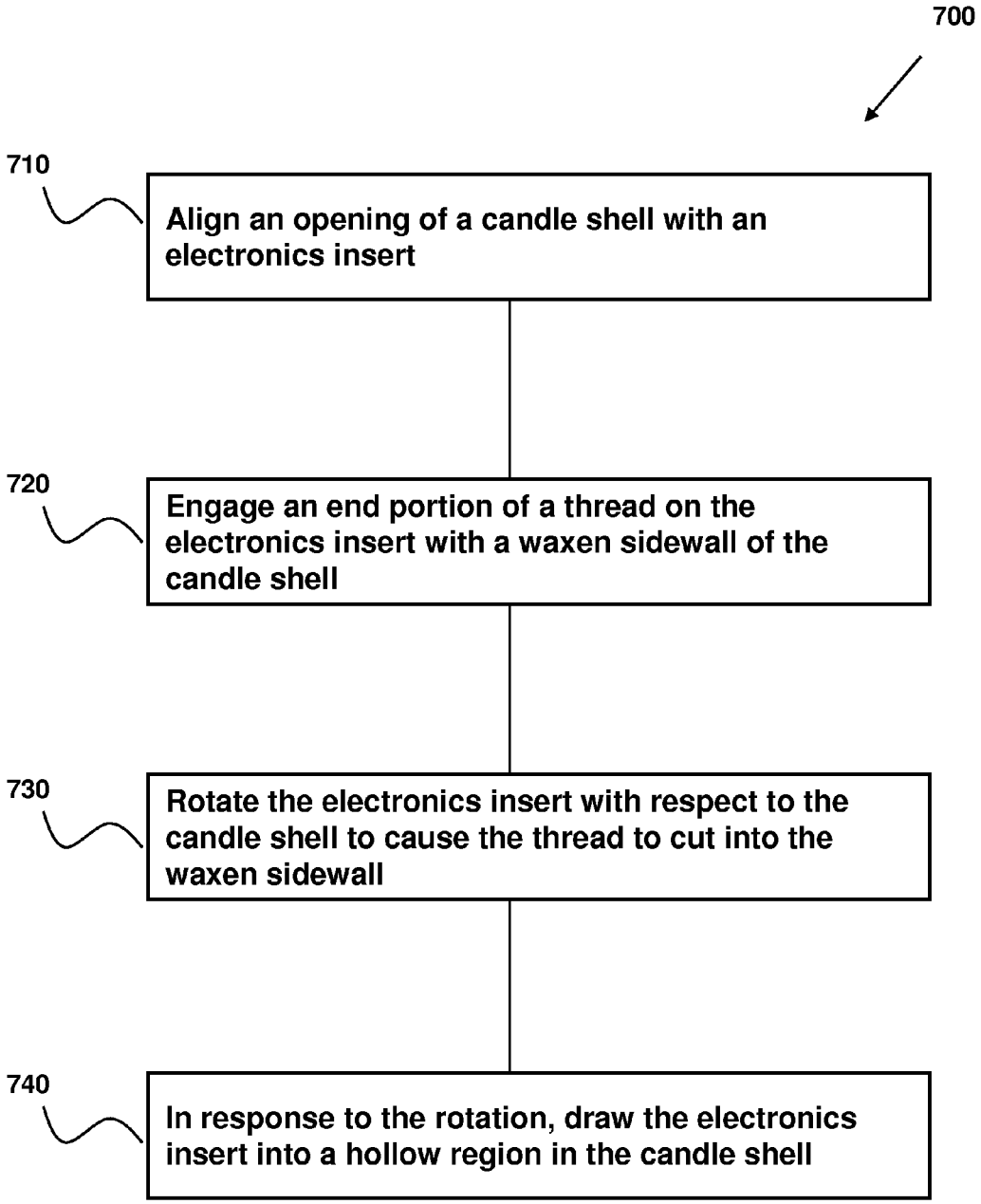
FIG. 7 shows a flowchart of a method for assembling a flameless candle, according to an embodiment of the present invention.

FIG. 7 shows a flowchart 700 of a method for assembling a flameless candle, according to an embodiment of the present invention. Some steps illustrated in the flowchart 700 may be performable in a different order, simultaneously, or some steps may be omitted according to preferences and different embodiments.

At step 710, the electronics insert 200 is aligned with the opening 330 in the candle shell 300. At step 720, end portions of one or more threads 240 (for example, exterior threads) on the electronics insert 200 are engaged with the waxen sidewall 310 of the candle shell 300. The threads 240 may be self-tapping.

Prior to engagement of the threads 240, the first step 370 (not to be confused with a step of method 700) may be formed in a bottom region of the interior of the waxen sidewall 310. The first step 370 may be formed by removing or routing out waxen material from the waxen sidewall 310. Such removal may be performed by a tool, such as a drill attachment. The first step 370 may be tapered. When performing the engagement step 720, the end portions of the threads 240 may engage with the first step 370.

At step 730, the electronics insert 200 is rotated with respect to the candle shell 300. This causes the threads 240 to rotatably cut into the waxen sidewall 310 (for example, into the first step 370 of the waxen sidewall 310). A position of the electronics insert 200 may be maintained while the candle shell 300 is rotated with respect to the electronics insert 200. As another example, the electronics insert 200 may rotate while the position of the candle shell 300 is substantially maintained. As another example, both the electronics insert 200 and the candle shell 300 may be complimentarily rotated. In addition to the torque force used for rotation, an inward force may also be applied to the electronics insert 200 and/or the candle shell 300.

The rotation of the electronics insert 200 and/or candle shell 300 may be facilitated by one or more tools, such as tool 510 discussed above. A step may be provided during which a tool is inserted into a battery compartment 250 of the electronics insert 200. The battery compartment 250 may provide a useful location for placement of a tool to stabilize and/or control the rotation of the electronics insert 200, especially if there are no batteries in the battery compartment 250. At step 740, in response to the rotation, the electronics insert 200 is drawn into the hollow region 330 in the candle shell 300.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. For example, many of the techniques described herein with respect to candle shell 300 may also be applicable to the use of candle shell 100. Therefore, it is intended that the invention not be limited to the particular embodiment disclosed, but that the invention will include all embodiments falling within the scope of the appended claims.

The invention claimed is:

1. A flameless candle comprising:
a candle shell including:
a waxen sidewall surrounding a hollow region, and
an opening through a bottom of the candle shell into the hollow region; and
an electronics insert including a housing and at least one exterior thread arranged on a lateral portion of the housing, wherein the at least one thread is configured to:
draw the electronics insert through the opening and into the hollow region of the candle shell in response to a torque force, and
secure the electronics insert in the candle shell.

2. The flameless candle of claim 1, wherein the at least one exterior thread comprises a self-tapping thread configured to cut into the waxen sidewall.

3. The flameless candle of claim 1, wherein the at least one exterior thread comprises a plurality of exterior threads.

4. The flameless candle of claim 3, wherein the plurality of exterior threads are configured to substantially draw the electronics insert into the hollow region when the plurality of exterior threads are rotated approximately one quarter of a turn.

5. The flameless candle of claim 1, wherein the waxen sidewall includes a first step configured to receive the at least one thread.

6. The flameless candle of claim 1, wherein the first step is tapered.

7. The flameless candle of claim 1, wherein a threadform of the at least one exterior thread comprises a trapezoid.

8. A flameless candle comprising:
a candle shell including a hollow region;
an electronics insert means for insertion the hollow region of the candle shell; and
an exterior thread means for:
drawing the electronics insert means into the hollow region of the candle shell, and securing the electronics insert means with the candle shell in response to a torque force.

9. The flameless candle of claim 8, wherein the exterior thread means comprises at least one self-tapping thread.

10. The flameless candle of claim 8, wherein the exterior thread means comprises a plurality of exterior threads.

11. The flameless candle of claim 10, wherein the exterior thread means is further configured to draw the electronics insert means into the hollow region of the candle shell when the exterior thread means are rotated approximately one quarter of a turn.

12. The flameless candle of claim 8, wherein the candle shell includes a first step in a waxen sidewall configured to receive the exterior thread means.

13. A method for assembling a flameless candle, the method comprising:

aligning an opening in a bottom of a waxen sidewall of a candle shell with a lateral portion of a housing of an electronics insert;

engaging at least one end portion of at least one exterior thread located on the lateral portion of electronics insert with the waxen sidewall;

causing the at least one exterior thread to rotatably cut into the waxen sidewall by rotating the electronics insert with respect to the candle shell; and responsively drawing the electronics insert into a hollow region in the candle shell.

14. The method of claim 13, further comprising inserting a tool into a battery compartment of the electronics insert to facilitate said causing the at least one exterior thread to rotatably cut into the waxen sidewall.

15. The method of claim 13, wherein said causing the at least one exterior thread to rotatably cut into the waxen sidewall comprises substantially maintaining the position of the electronics insert while twisting the candle shell.

16. The method of claim 13, further comprising forming a first step in a bottom region of an interior of the waxen sidewall, and wherein:

said engaging at least one end portion of at least one exterior thread further comprises engaging the at least one end portion with the first step; and said causing the at least one exterior thread to rotatably cut into the waxen sidewall further comprises causing the at least one exterior thread to rotatably cut into the first step of the waxen sidewall.

17. The method of claim 13, further comprising forming a first step in the waxen sidewall by removing a portion of wax from the inner surface of the waxen sidewall.

18. The method of claim 17, wherein the first step is tapered.

19. The method of claim 13, wherein the at least one exterior thread comprises a self-tapping thread.

20. The method of claim 13, wherein:

the at least one exterior thread comprises a plurality of exterior threads, and the at least one end portion comprises a corresponding plurality of end portions.

* * * * *